US006307449B1

(12) United States Patent
Matsuo et al.

(10) Patent No.: US 6,307,449 B1
(45) Date of Patent: Oct. 23, 2001

(54) FILTER WITH SPURIOUS CHARACTERISTIC CONTROLLED

(75) Inventors: Michiaki Matsuo; Hiroyuki Yabuki, both of Kawasaki; Mitsuo Makimoto, Yokohama, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/612,965

(22) Filed: Jul. 10, 2000

Related U.S. Application Data

(63) Continuation of application No. 09/102,084, filed on Jun. 22, 1998, now abandoned.

(30) Foreign Application Priority Data

Jun. 24, 1997 (JP) ..... 9-166960

(51) Int. Cl.[7] ..... H01P 1/203; H01P 1/212
(52) U.S. Cl. ..... 333/202; 333/204; 333/219.1
(58) Field of Search ..... 333/202–204, 333/208, 219.1, 251, 211, 228

(56) References Cited

U.S. PATENT DOCUMENTS

| | | | | |
|---|---|---|---|---|
| 3,958,194 | * | 5/1976 | Klein et al. | 333/211 X |
| 4,020,428 | | 4/1977 | Friend et al. | 333/203 |
| 4,138,652 | | 2/1979 | Nishikawa et al. | 333/251 |
| 4,142,164 | | 2/1979 | Nishikawa et al. | 333/202 X |
| 4,237,434 | | 12/1980 | Cappucci | 333/251 X |
| 4,692,723 | | 9/1987 | Fiedziuszko et al. | 333/251 X |
| 5,025,235 | | 6/1991 | Pramanick | 333/204 |
| 5,172,084 | | 12/1992 | Fiedziuszko et al. | 333/204 |

FOREIGN PATENT DOCUMENTS

| | | | | |
|---|---|---|---|---|
| 58-63201 | | 4/1982 | (JP) | 333/204 |
| 59-114904 | * | 7/1984 | (JP) . | |
| 61-159805 | * | 7/1984 | (JP) . | |
| 60-248001 | | 12/1985 | (JP) | 33/202 |
| 6-177605 | | 6/1994 | (JP) | 333/202 |
| 7-202507 | | 8/1995 | (JP) . | |
| 226193 | * | 4/1959 | (SU) | 333/228 |

OTHER PUBLICATIONS

Jasberg, "Improvement of Power Output from Pulsed Kystrons," Proceedings of IRE vol. 2, No. 5, May 1954.*

* cited by examiner

*Primary Examiner*—Justin P. Bettendorf
(74) *Attorney, Agent, or Firm*—Israel Gopstein

(57) ABSTRACT

A filter of microwave and millimetric bands with spurious characteristic controlled is disclosed. A filter circuit on a top surface of the substrate including resonators electromagnetically resonating and coupled at a resonance frequency at a microwave band and a millimeter wave band, for filtering an input signal from the connectors through the resonator and outputting the filtered signal through the connector. The filter circuit is contained in a metal box including a top plate confronting the top surface and the filter circuit, side walls, and a bottom plate. An inside surface of the top plate has a shape other than a flat plane to control the spurious characteristic, that is, a protrusion. The bottom plate of the metal box may be coalesced. The spurious characteristic may be controlled by a hollow portion in the top plate. The protruding portion may be provided to the side walls. The spurious frequency may be controlled by a dielectric plate in the space in the shielding. Microstrip line resonators, patch resonators, or dielectric resonators are used as the resonator.

21 Claims, 8 Drawing Sheets

FILTER WITH SPURIOUS CHARACTERISTIC CONTROLLED

This application is a Continuation of application Ser. No. 09/102,084 filed Jun. 22, 1998 abandoned.

BACKGROUND OF THE INVENTION

1. Field of the Invention

This invention relates to a filter circuit for filtering a high frequency signal of the microwave band or the millimeter wave band.

2. Description of the Prior Art

A filter including resonators on a printed circuit board contained in a metal box for filtering an input signal of the microwave band or the millimeter wave band through the resonators is known. Such a prior art filter is disclosed in Japanese patent application provisional publication No. 7-202507. FIG. 11 is a plan view, partially cross-sectional view, of this prior art filter. An input signal is transferred by resonators 1*a* top 1*c* on a substrate 2 contained in a box to output the filtered signal. A radio wave absorbing material 9 is provided on the inside walls of the case 8 to suppress disturbance in electromagnetic mode and to suppress generation of harmonics to reduce noise.

SUMMARY OF THE INVENTION

The aim of the present invention is to provide a superior filter.

According to the present invention there is provided a first filter including: a substrate; at least a connector for providing electrical connection; a filter circuit on a top surface of the substrate including at least a resonator electromagnetically resonating at a resonance frequency at a microwave band and a millimeter wave band, for filtering an input signal from the connection means through the resonator and outputting the filtered signal through the connector; a metal box including a top plate confronting the top surface and the filter circuit, side walls, and a bottom plate, for containing and supporting the substrate and filter circuit, a portion of the side walls supporting the connector, wherein a first portion of the input signal is transferred through the filter circuit and a second portion of the input signal is transferred through a portion of the metal box in the wave-guided mode, the second portion providing a spurious characteristic of the filter, an inside surface of the top plate having a shape other than a plane to control the spurious characteristic.

In the first filter, the inside surface may have a hollow portion.

In the first filter, the top plate has a thickness between a top surface thereof and the inside surface and the thickness may successively increase and then, successively decrease in a direction.

In the first filter, the top plate has a thickness between a top surface thereof and the inside surface and the thickness may decrease stepwise and then, increase stepwise in a direction.

In the first filter, the inside surface may have at least triangle pole.

In the first filter, the inside surface may have a plurality of triangle poles arranged in a direction.

In the first filter, the inside surface may have a protruding portion and the protruding portion and the top plate are monolithic.

According to the present invention there is provided a second filter including: a substrate; at least a connector for providing electrical connection; a filter circuit on a top surface of the substrate including at least a resonator electromagnetically resonating at a resonance frequency at a microwave band and a millimetric wave band, for filtering an input signal from the connection means through the resonator and outputting the filtered signal through the connector; a metal box including a top plate confronting the top surface and the filter circuit, side walls, and a bottom plate, for containing and supporting the substrate and filter circuit, a portion of the side walls supporting the connection means, wherein a first portion of the input signal is transferred through the filter circuit and a second portion of the input signal is transferred through a portion of the metal box in a guided mode, the second portion providing a spurious characteristic of the filter, the side wall having a protruding portion to control the spurious characteristic.

According to the present invention there is provided a second filter including: a substrate; at least a connector for providing electrical connection; a filter circuit on a top surface of the substrate including at least a resonator electromagnetically resonating at a resonance frequency at a microwave band and a millimeter wave band, for filtering an input signal from the connection means through the resonator and outputting the filtered signal through the connection means; a metal box including a top plate confronting the top surface and the filter circuit, side walls, and a bottom plate, for containing and supporting the substrate and filter circuit, a portion of the side walls supporting the connector; a dielectric plate on an inside surface of the metal box on the side of the top surface, wherein a first portion of the input signal is transferred through the filter circuit and a second portion of the input signal is transferred through a portion of the metal box and the dielectric plate in a guided mode, the second portion providing a spurious characteristic of the filter, the dielectric plate controlling the spurious characteristic.

In the first to third filters, the resonator may include a microstrip line.

In the first to third filters, the resonator may include a patch resonator.

In the first to third filters, the resonator may include a dielectric resonator.

In the first to third filters, the side walls may be combined with the bottom plate.

In the first to third filters, the side walls may be combined with the top plate.

In the first to third filters, the filter may include a connector.

BRIEF DESCRIPTION OF THE DRAWINGS

The object and features of the present invention will become more readily apparent from the following detailed description taken in conjunction with the accompanying drawings in which.

The same or corresponding elements or parts are designated with like references throughout the drawings.

DETAILED DESCRIPTION OF THE INVENTION

FIRST EMBODIMENT

Figure 1A:
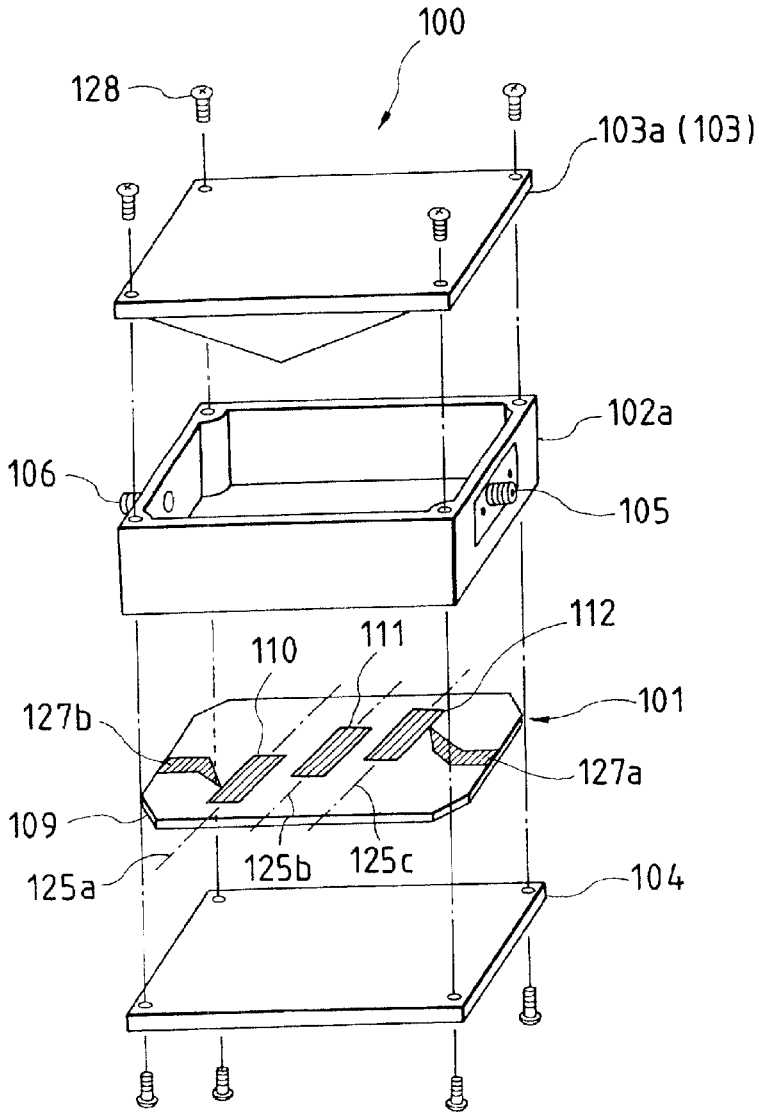
FIG. 1A is a perspective view of a filter of a first embodiment, wherein respective portions are shown in a disassembled condition.
Figure 1B:
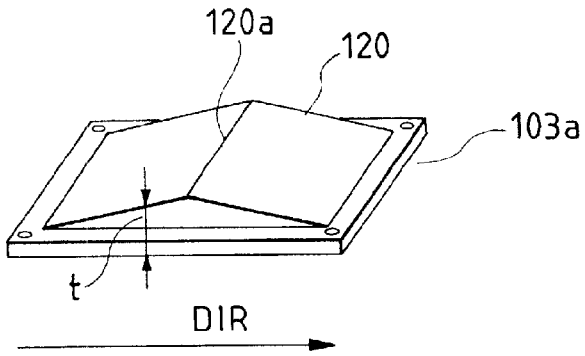
FIG. 1B is a perspective view of a top plate shown in FIG. 1A.

FIG. 1A is a perspective view of a filter of a first embodiment, wherein respective portions are shown in a disassembled condition. FIG. 1B is a perspective view of a top plate shown in FIG. 1A upside down.

The filter of the first embodiment includes a substrate 109 of a dielectric material, connectors 105 and 106 for inputting a signal and outputting the filtered signal, a filter circuit 101 on a top surface of the substrate 109 including resonators 110 to 112 electromagnetically resonating at a resonance frequency at a microwave band and a millimeter wave band, for filtering the input signal from one of the connectors 105 and 106 through the resonators 110 to 112 and outputting the filtered signal through another of the connectors 105 and 106, a metal box (conductive box) 100 including the top plate 103*a* of which inside (lower) surface confronting the top surface of the substrate 109 and the filter circuit 101, side walls 102, and a bottom plate 104, for containing and supporting the substrate 109 and the filter circuit 101, a portion of the side walls supporting the connectors 105 and 106, wherein a first portion of the input signal is transferred through the filter circuit 101 and a second portion of the input signal is transferred through a portion of the conductive box 100 in the wave-guided mode, the second portion providing a spurious characteristic of the filter, an inside (lower) surface of the top plate 103a having a shape 120 other than a flat plane to control the spurious characteristic.

The connector 105 fixed on the side wall 102*a* receives the signal of a microwave band or a millimetric band through a microstrip line 127*a* and supplies it to the resonator 112. The filter circuit 101 is of side coupling type band pass filter for transferring the necessary band and suppress components at the unnecessary bands. Each of resonators 110 to 112 comprises a microstrip line and transfers a first portion of the input signal to the resonator 111 through edge coupling at component of the resonance frequency and neighbour frequencies. The filtered signal is outputted by the connector 106 fixed to one of the side walls 102*a* through a microstrip line 127*b* connected to the connector 106. In designing the filter 101, it is assumed that the number of the resonators, the number of stages of the filter circuits, and the coupling degree of inputting and outputting the signal are adequately designed to satisfy the attenuation characteristic in the condition that the affection of the guided mode is neglected.

The shielding by the metal box 100 is provided to the filter circuit 101 for two reasons. First, the shielding is provided to prevent that the transmission loss in the filter 101 increases and the transfer characteristic curve rounds because if there is no shielding the unloaded Q decreases due to radiation of an electromagnetic energy from the filter circuit 101. Second, shielding prevents disturbance in the filter characteristic due to influence on coupling between resonators by external electromagnetic fields.

However, the shielding causes wave-guided mode resonating and transmits the second portion of the signal through the shielding which is outputted at the connector 106 as a spurious component. If the spurious resonance frequency exists in the stop band, though the band pass filter circuit 101 itself satisfies the attenuation characteristic, the output of the filter will not satisfy the desired attenuation characteristic.

In this invention, the spurious resonance frequency (wave-guided mode resonance frequency) is shifted to satisfy the attenuation characteristic. More specifically, in the first embodiment, the spurious resonance frequency is shifted by making the shape of the inside surface of the top plate 103*a* confronting the filter circuit 101 protruded. In FIG. 1B, the top plate 103*a* has the shape 120 of a triangle pole on the surface confronting the filter circuit 101. The ridge line 120*a* of the triangle pole confronts a center line in the longitudinal direction of the resonator 111 to provide a symmetric structure.

The top plate 103*a* is fixed to the side walls 102*a* by screws 120, so that the top plate 103*a* is removable. Moreover, the spurious characteristic can be controlled only by providing the top plate 103 having a different shape without preparing the whole of the metal box 100.

In the above-mentioned description, the top plate 103*a* and the bottom plate 104 are removable. However, it is also possible to make the side walls 102*a* and the bottom, plate 104 in a united one body to increase the degree of grounding. Alternatively, the top plate 103*a* and the side walls 102*a* are coalesced.

In this structure, the transmission loss does not decrease essentially because the spurious resonance frequency is only shifted.

A second portion of the signal from the connector 105 is transferred through the top plate 103*a* in the wave-guided mode at a guide mode resonance frequency and outputted by the connector 106, so that a spurious output appears in the output of the filter.

Figure 2A:
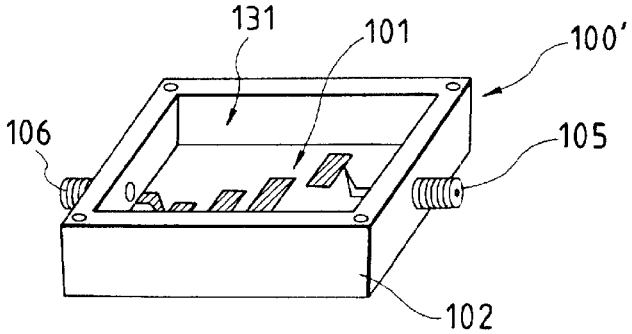
FIGS. 2A and 2B are perspective views of the filter of the first embodiment in partially assembled condition.
Figure 2B:
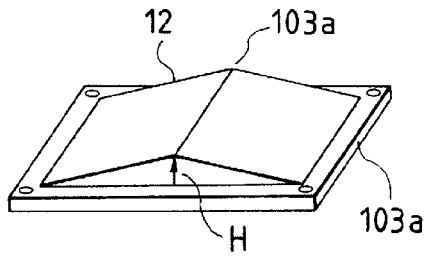
Figure 3:
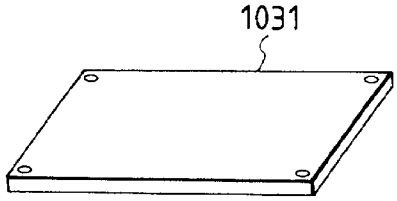
FIG. 3 PRIOR ART
FIG. 3 is a top plate of a prior art.
Figure 4:
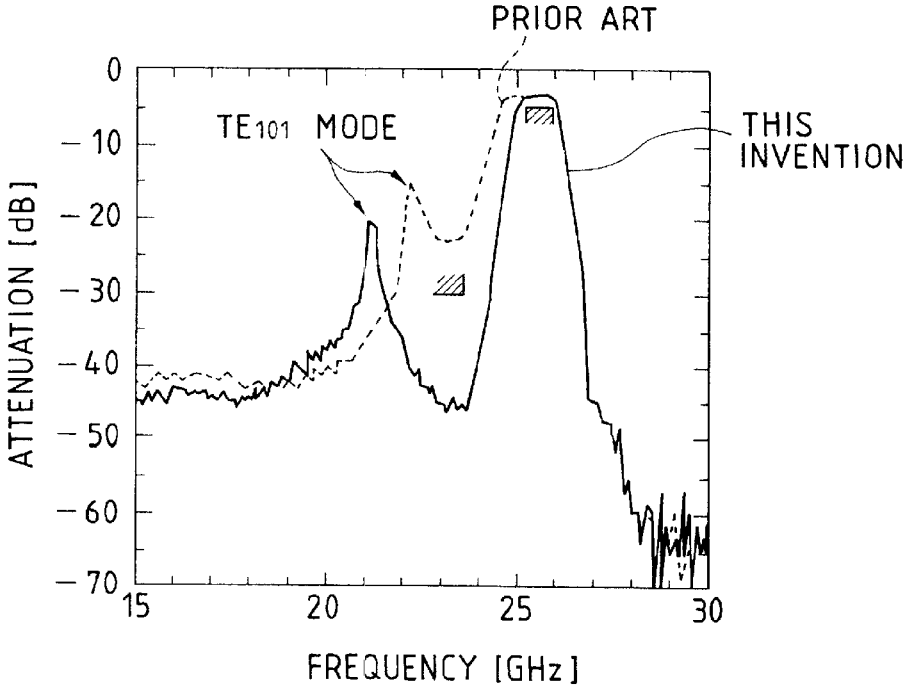
FIG. 4 shows an attenuation characteristic of the first embodiment, wherein the attenuation characteristic of prior art is also shown.

FIGS. 2A and 2B are perspective views of the filter of the first embodiment without the top plate. FIG. 3 is a top plate 1031 of a prior art. FIG. 4 shows attenuation characteristic of the first embodiment, wherein the attenuation characteristic of prior art is also shown.

The metal box 100' has the side walls 102 and bottom plate coalesced. The filter 101 is of four-stage coupling type and includes resonators 110 to 112 comprising microstrip lines formed on a Teflon substrate having a thickness of 10 mil (about 0.254 mm) and a dielectric constant of 2.2. The pass band is 25 GHz band. The dimensions of the filter 101 is 12 mm×8 mm. The dimensions of the shielded space 131 inside the metal box 100' on the substrate is 12 mm×8 mm×3 mm.

In FIG. 4, the chain line of the attenuation characteristic is obtained by the structure of the filter circuit shown in FIG.

2A and the top plate shown in FIG. 3 and the solid line of the attenuation characteristic is obtained by the structure of the filter circuit shown in FIG. 2A and the top plate 103*a* in FIG. 2B.

In FIG. 4, peaks due to spurious around 22 GHz are caused by resonating through the shielding in $TE_{101}$ mode, which depends on the dimensions of the filter 101. If the attenuation amount is required more than 30 dB at 23.5 GHz, the filter 101 itself satisfies the attenuation characteristic but the wave-guided mode transmission through shielding occurs near the specified frequency (23.5 GHz), so that the attenuation characteristic of the prior art (chain line) rises (in the drawing) and the attenuation characteristic of the prior art does not satisfy the attenuation requirement.

On the other hand, in the attenuation characteristic of this invention, the peak of the spurious is shifted with respect to frequency by 1.4 GHz, that is the spurious peak frequency is lowered, so that the attenuation characteristic satisfies the attenuation requirement at the specified frequency. A height H of the peak of the triangle pole (protruding portion) 120 is about 2 mm to prevent from the protruding portion 120 to contact with the filter 101.

In this embodiment, as shown in FIG. 1B, the top plate 103*a* has a thickness t between a top surface thereof and the inside surface and the thickness t successively increases and then, successively decreases in a direction DIR. Moreover, the protruding portion 120 and the top plate 103*a* are monolithic (structure). Further, the inside surface has at least triangle pole as the protruding portion 120.

SECOND EMBODIMENT

Figure 5A:
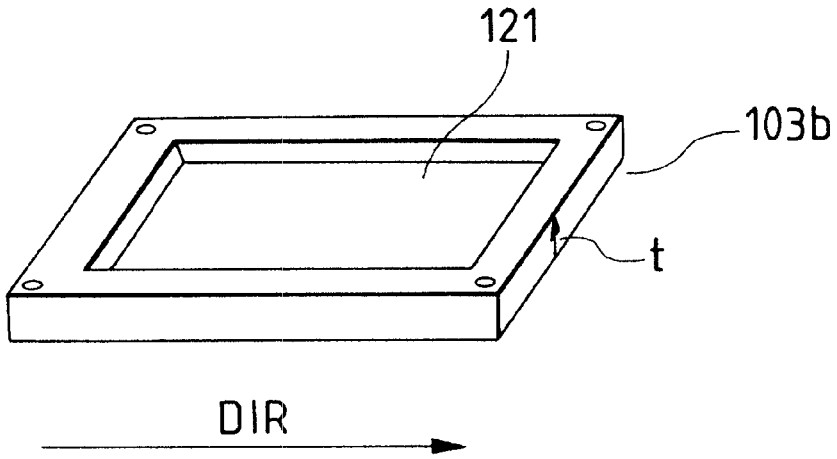
FIGS. 5A and 5B are perspective views of top plates of a second embodiment.
Figure 5B:
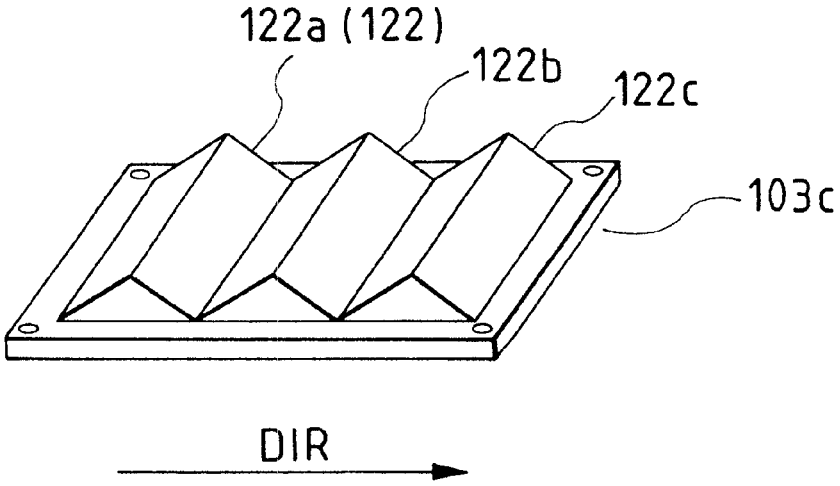

FIGS. 5A and 5B are perspective views of top plates of the second embodiment. The structure of the second embodiment is substantially the same as that of the first embodiment. The difference is in that the shape of the top plate is different.

In FIG. 5A, a hollow portion 121 is provided in the top plate 103*b*.

In FIG. 5B, three triangle poles (protruding portions) 122*a* to 122*c* are provided to the top plate 103*c*. The triangle poles 122*a* to 122*c* confront the resonators 110 to 112 respectively and each of the triangle poles 122 has a symmetric shape with respect to the center lines 125*a* to 125*c* in the longitudinal direction of the resonators.

The hollow portion 121 and the protruding portions 122*a* to 122*c* control the spurious characteristic.

In this embodiment, as shown in FIG. 5A, the top plate 103*b* has a thickness t between a top surface thereof and the inside surface thereof and the thickness t decreases stepwise and then, increases stepwise in the direction DIR. Moreover, the inside surface has a plurality of triangle poles 122*a* to 122*c* arranged in a direction DIR.

THIRD EMBODIMENT

Figure 6:
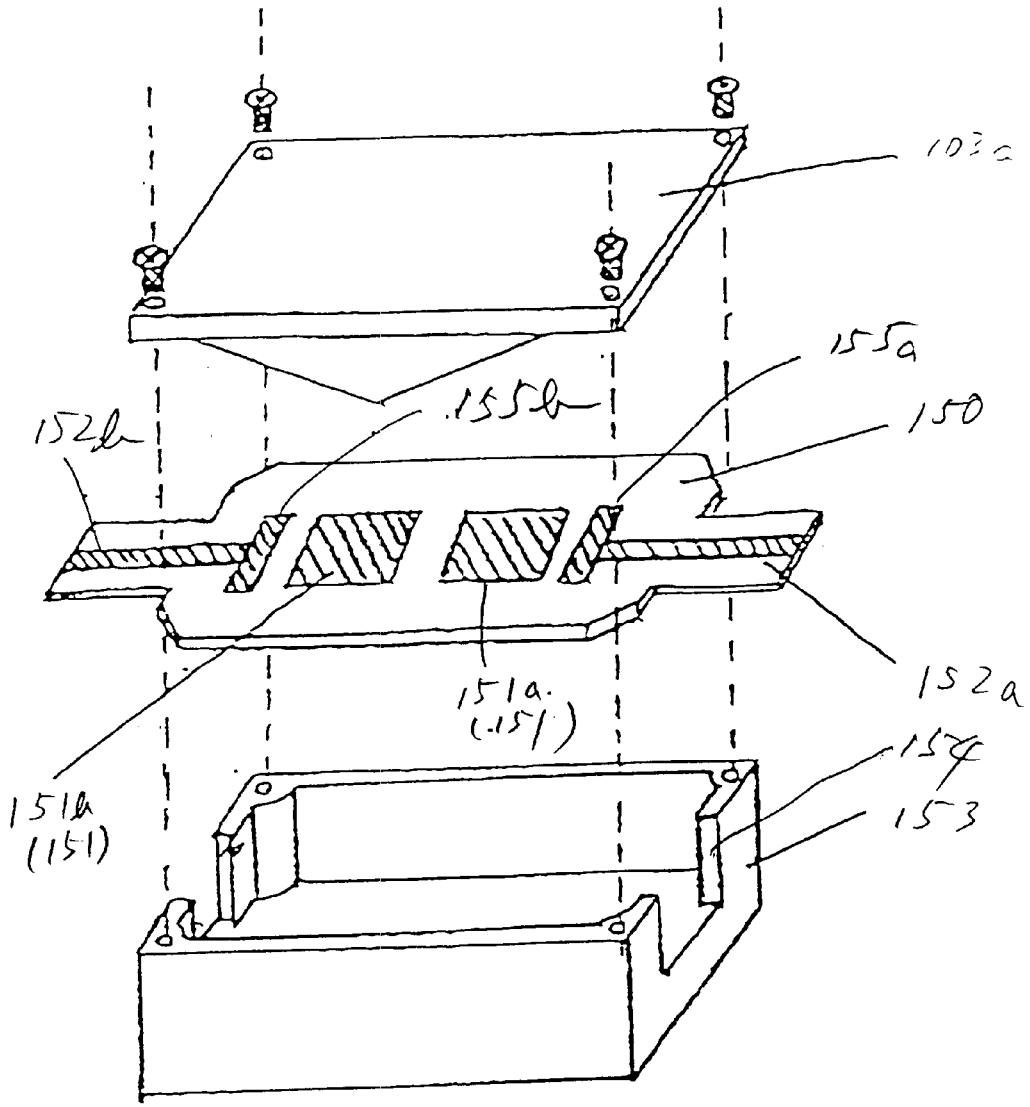
FIG. 6 is a perspective view of a filter of a third embodiment, wherein respective portions are shown in a disassembled condition.

FIG. 6 is a perspective view of a filter of the third embodiment, wherein respective portions are shown in a disassembled condition. The structure of the third embodiment is substantially the same as that of the first embodiment. The difference is in that microstrip lines 152*a* and 152*b* on a substrate 150 extending from the filter circuit outside the metal box for receiving the signal and outputting the filtered signal and patch resonators 151 are provided instead the microstrip line resonators 110 to 112, side walls 153 has notches 154 to extend the microstrip line 152*a* and 152*b* externally.

A signal is inputted through the microstrip line 152*a* and coupled to patch resonator 151*a* through a coupling line 155*a*. The patch resonator 151*a* resonates at the resonance frequency and is coupled to the patch resonator 151b. The patch resonator 151*b* resonates at the resonance frequency and is coupled to the microstrip line 152*b* through a coupling line 155*b*. The filtered signal is outputted by the microstrip line 152*b* through the coupling line 155*b*.

The peak of spurious is also shifted on the frequency basis by the protruding portion 120 on the top plate 103*a*.

FOURTH EMBODIMENT

Figure 7:
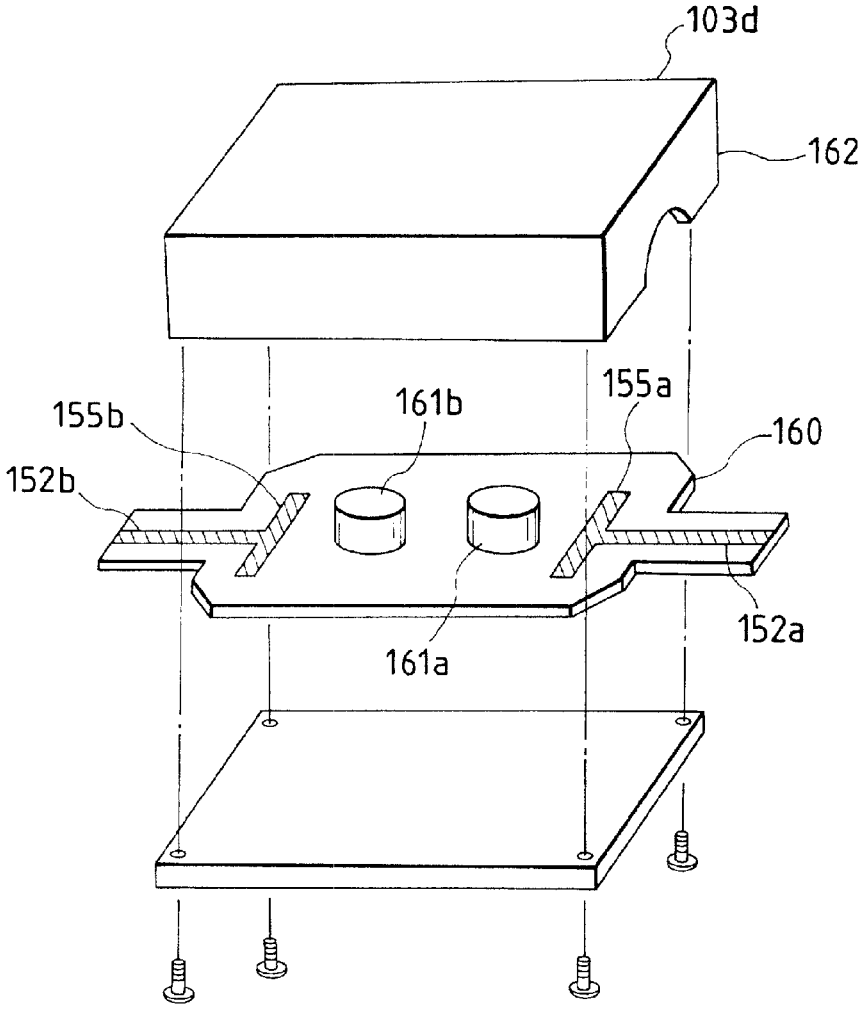
FIG. 7 is a perspective view of a filter of a fourth embodiment, wherein respective portions are shown in a disassembled condition.
Figure 8:
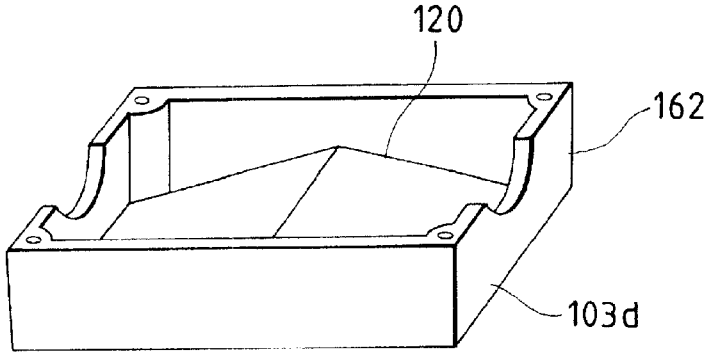
FIG. 8 is a perspective view of the fourth embodiment showing the top plate shown in FIG. 7 upside down.

FIG. 7 is a perspective view of a filter of the fourth embodiment, wherein respective portions are shown in a disassembled condition. FIG. 8 is a perspective view of the fourth embodiment showing the top plate shown in FIG. 7 upside down. The structure of the third embodiment is substantially the same as that of the third embodiment. The difference is in that dielectric resonators 161*a* and 161*b* are provided Instead the patch resonators 151*a* and 151*b* and the side walls 162 is combined with the top plate 103*d*.

A signal is inputted through the microstrip line 152*a* and coupled to dielectric resonator 161*a* through a coupling line 155*a*. The dielectric resonator 161*a* is coupled to the coupling line 155*a* and resonates at the resonance frequency and is coupled to the dielectric resonator 161*b*. The dielectric resonator 161*b* resonates at the resonance frequency and is coupled to the microstrip line 152*b* through the coupling line 155*b*. The filtered signal is outputted by the microstrip line 152*b* through the coupling line 155*b*.

The peak of spurious is also shifted on the frequency basis by the protruding portion 120 on the top plate 103*d*.

FOURTH EMBODIMENT

Figure 9:
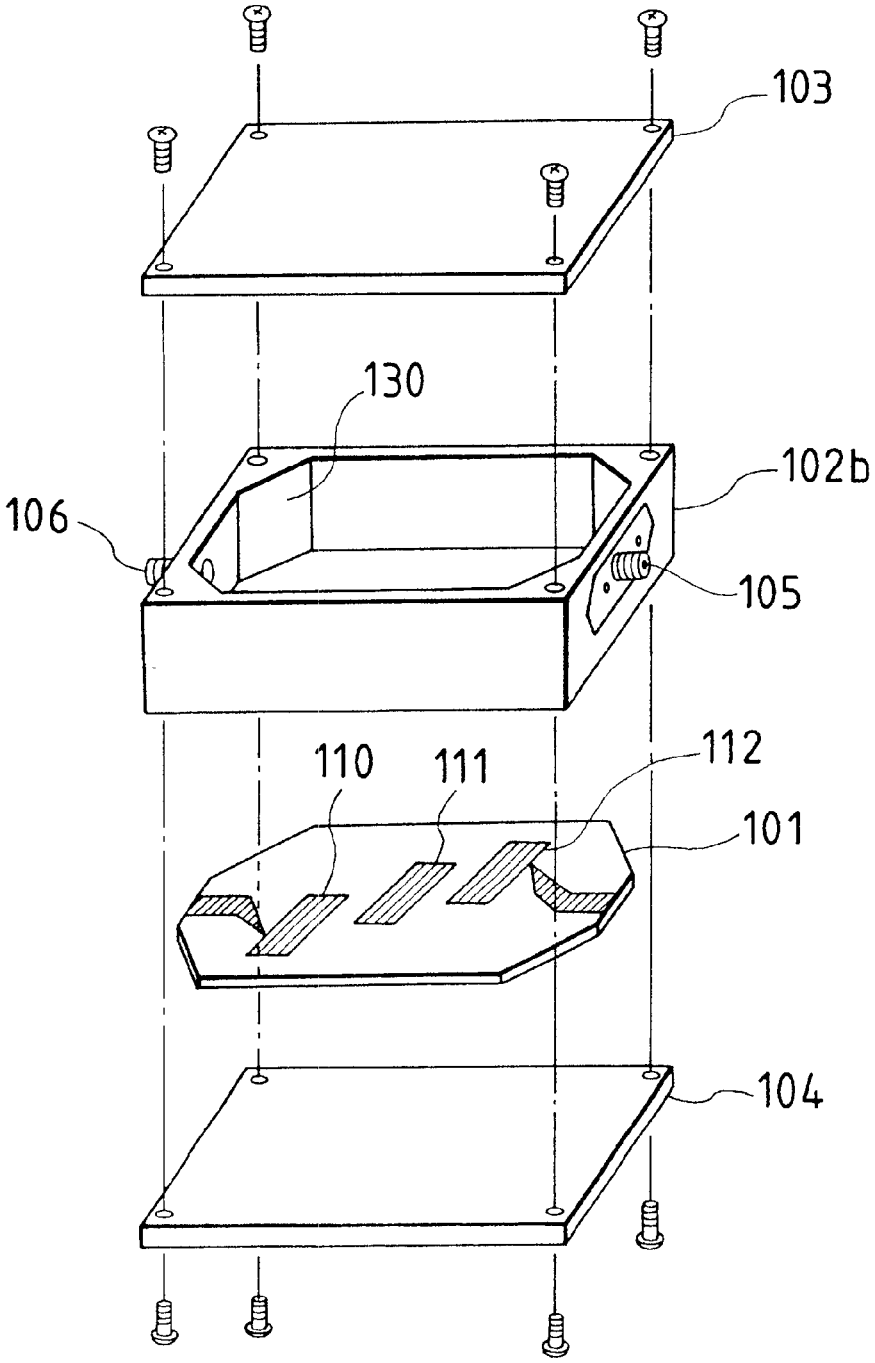
FIG. 9 is a perspective view of a filter of a fourth embodiment, wherein respective portions are shown in a disassembled condition.

FIG. 9 is a perspective view of a filter of the fourth embodiment, wherein respective portions are shown in a disassembled condition. The structure of the fourth embodiment is substantially the same as that of the first embodiment. The difference is in that the shape of the side walls is different. That is, protruding portions 130 are provided to the side walls 102*b*. The protruding portions 130 are provided to the corners of the side walls 102*b* to make the space in the shielding narrower to shift the spurious resonance frequency. The protruding portions may be provided on the inside surface of the side walls 102*b* other than the corners without the protruding portions touching the resonators 110 to 112. In FIG. 9, the resonators comprise microstrip lines and the signal is inputted and outputted by the connector 105 and 106. However, it is also possible that the resonators comprise patch resonators as shown in FIG. 6 or dielectric resonator as shown in FIG. 7 and the connectors comprises microstrip lines as shown in FIG. 7. Moreover, the top plate 103 may be combined with the side walls 102*b* as shown in FIG. 8 or the bottom plate 104 may be combined with the side walls 102*b* as shown in FIG. 6.

FIFTH EMBODIMENT

Figure 10:
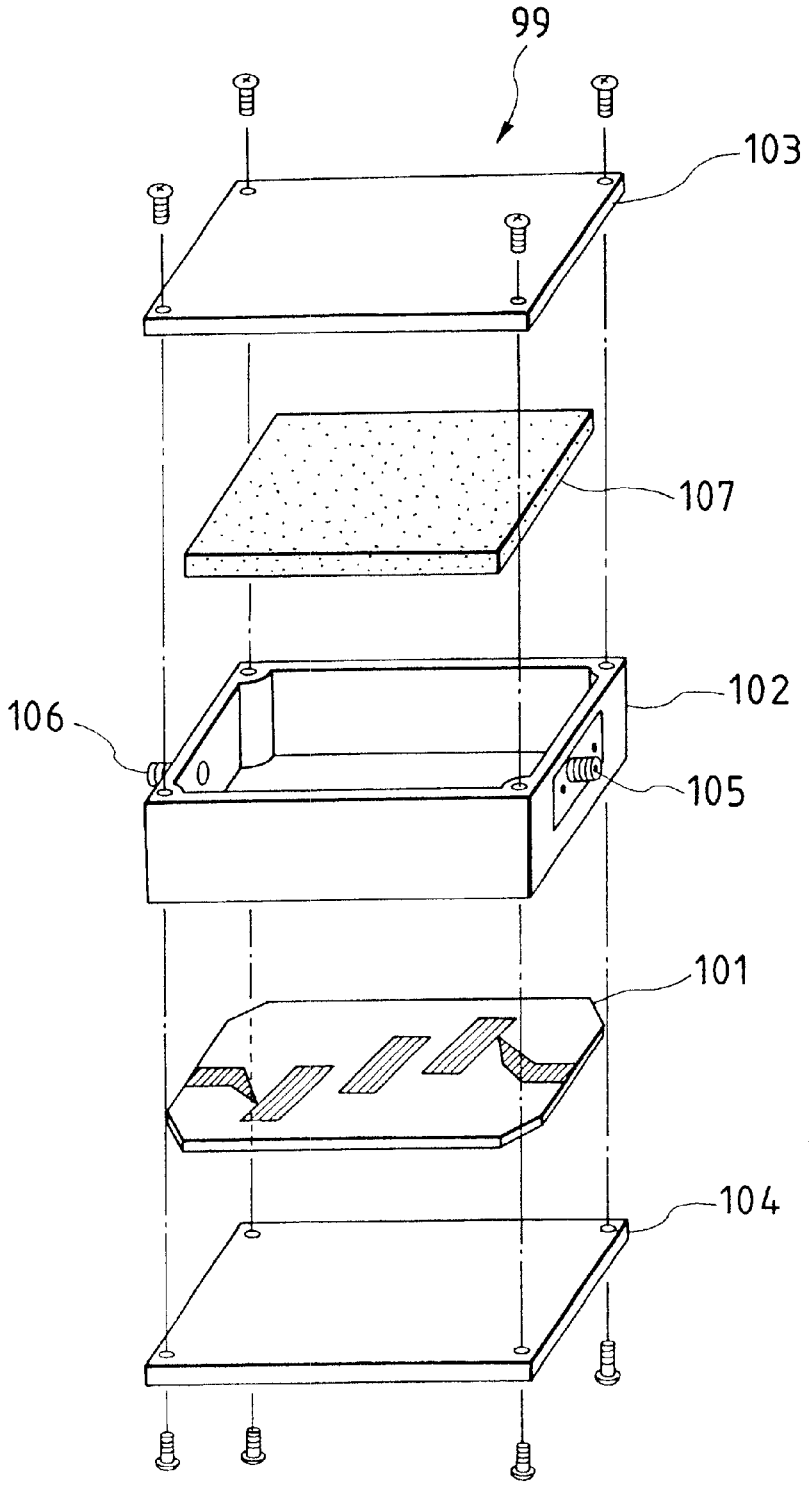
FIG. 10 is a perspective view of a filter of a fifth embodiment, wherein respective portions are shown in a disassembled condition.
Figure 11:
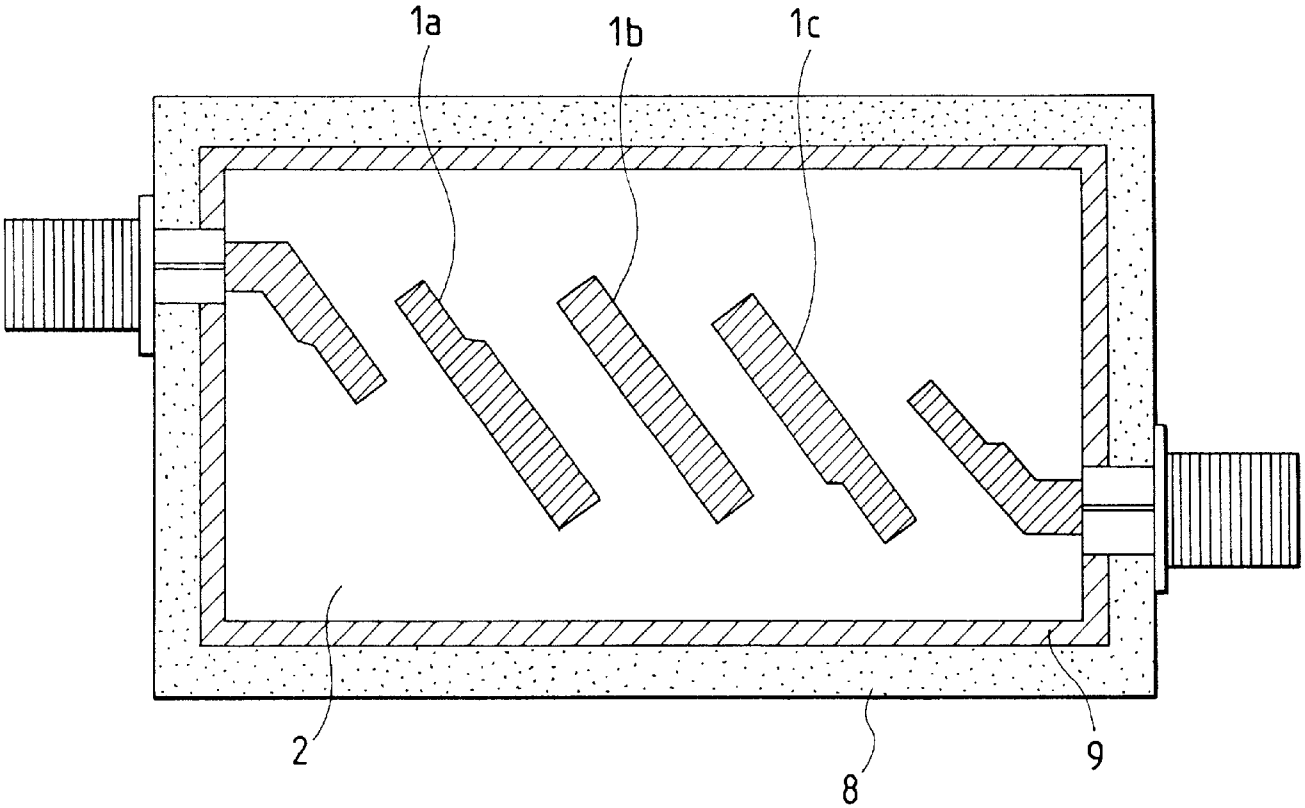
FIG. 11 PRIOR ART
FIG. 11 is a plan view, partially cross-sectional view, of a prior art filter.

FIG. 10 is a perspective view of a filter of the fifth embodiment, wherein respective portions are shown in a disassembled condition. The structure of the fifth embodiment is substantially the same as that of the first embodiment. The difference is in that controlling the spurious characteristic is provided by a dielectric plate 107 without the protruding portion on the inside surface of the metal box 99.

The dielectric plate 107 is fixed on the inside flat surface of the top plate 103 to control the spurious characteristic. That is, the dielectric plate 107 shifts the spurious resonating frequency. The dielectric plate 107 may be provided on the inside surface of the side walls 102. That is, the spurious characteristic can be controlled by providing the dielectric plate 107 in the inside space of the metal box 99 above the filter circuit 101 if there is no large influence on the dielectric plate to the basic characteristic of the filter circuit 101.

In FIG. 10, the resonators comprise microstrip lines and the signal is inputted and outputted by the connectors 105 and 106. However, it is also possible that the resonators comprise patch resonators as shown in FIG. 6 or dielectric resonator as shown in FIG. 7 and the connectors comprises microstrip lines as shown in FIG. 7. Moreover, the top plate 103 may be combined with the side walls 102 as shown in FIG. 8 or the bottom plate 104 may be combined with the side walls 102*b* as shown in FIG. 6.

What is claimed is:

1. A filter comprising:

a substrate;

connection means for providing electrical connection;

a filter circuit on a top surface of said substrate including at least a resonator electromagnetically resonating at a resonance frequency at a microwave band and a millimeter wave band, for filtering an input signal from said connection means through said resonator and outputting the filtered signal through said connection means;

a metal box including a top plate confronting said top surface and said filter circuit, side walls, and a bottom plate, for containing and supporting said substrate and filter circuit, a portion of said side walls supporting said connection means, wherein a first portion of said input signal is transferred through said filter circuit and a second portion of said input signal is transferred through a portion of said metal box in the wave-guided mode, said second portion providing a spurious characteristic of said filter, an inside surface of said top plate having a shape other than a plane to control the spurious characteristic, wherein said top plate has a thickness between a top surface thereof and said inside surface and said thickness successively increases and then, successively decreases in a direction.

2. The filter as claimed in claim 1, wherein said inside surface has a protruding portion.

3. The filter as claimed in claim 1, wherein said inside surface of said top plate has a plurality of triangle poles arranged in a direction to have said shape other than a plane.

4. The filter as claimed in claim 1, wherein said resonator comprises a microstrip line.

5. A filter as claimed in claim 1, wherein a spurious resonance frequency in said spurious characteristic is shifted by said shape of said inside surface of said top plate.

6. The filter as claimed in claim 1, wherein said resonator comprises a dielectric resonator.

7. The filter as claimed in claim 1, wherein said side walls are combined with said bottom plate.

8. The filter as claimed in claim 1, wherein said side walls are combined with said top plate.

9. A filter comprising:

a substrate;

connection means for providing electrical connection;

a filter circuit on a top surface of said substrate including at least a resonator electromagnetically resonating at a resonance frequency at a microwave band and a millimeter wave band, for filtering an input signal from said connection means through said resonator and outputting the filtered signal through said connection means; a metal box including a top plate confronting said top surface and said filter circuit, side walls, and a bottom plate, for containing and supporting said substrate and filter circuit, a portion of said side walls supporting said connection means, wherein a first portion of said input signal is transferred through said filter circuit and a second portion of said input signal is transferred through a portion of said metal box in the wave-guided mode, said second portion providing a spurious characteristic of said filter, an inside surface of said top plate having a shape other than a plane to control the spurious characteristic, wherein said top plate has a thickness between a top surface thereof and said inside surface and said thickness decreases stepwise and then, increases stepwise in a direction.

10. A filter comprising:

a substrate;

connection means for providing electrical connection;

a filter circuit on a top surface of said substrate including at least a resonator electromagnetically resonating at a resonance frequency at a microwave band and a millimeter wave band, for filtering an input signal from said connection means through said resonator and outputting the filtered signal through said connection means;

a metal box for containing and supporting said substrate and filter circuit, said metal box including: a top plate confronting said top surface of said substrate and said filter circuit, side walls, and a bottom plate;

wherein a first portion of said input signal is transferred through said filter circuit, a second portion of said input signal is transferred through said top plate of said metal box in the wave-guided mode, said second portion provides a spurious characteristic of said filter, and an inside surface of said top plate has a protruding portion in which a thickness of said top plate successively increases and then, successively decreases in a direction to shift a spurious resonance frequency in said spurious characteristic.

11. A filter comprising:

a substrate;

connection means for providing electrical connection;

a filter circuit on a top surface of said substrate including at least a resonator electromagnetically resonating at a resonance frequency at a microwave band and a millimetric wave band, for filtering an input signal from said connection means through said resonator and outputting the filtered signal through said connection means;

a metal box including a top plate confronting said top surface and said filter circuit, side walls, and a bottom plate, for containing and supporting said substrate and filter circuit, a portion of said side walls supporting said connection means, wherein a first portion of said input signal is transferred through said filter circuit and a second portion of said input signal is transferred through a portion of said metal box in a guided mode, said second portion providing a spurious characteristic of said filter, said side wall having a protruding portion to control the spurious characteristic, wherein said protruding portion is arranged at a comer of successive two of said side walls and combined with said successive two of said side walls.

12. The filter as claimed in claim 11, wherein said resonator comprises a microstrip line.

13. A filter as claimed in claim 11, wherein a spurious resonance frequency in said spurious characteristic is shifted by said protruding portion.

14. The filter as claimed in claim 11, wherein said resonator comprises a dielectric resonator.

15. The filter as claimed in claim 11, wherein said side walls are combined with said bottom plate.

16. The filter as claimed in claim 11, wherein said side walls are combined with said top plate.

17. A filter comprising:

a substrate;

connection means for providing electrical connection;

a filter circuit on a top surface of said substrate including at least a resonator electromagnetically resonating at a resonance frequency at a microwave band and a millimeter wave band, for filtering an input signal from said connection means through said resonator and outputting the filtered signal through said connection means;

a metal box including a top plate confronting said top surface and said filter circuit, side walls, and a bottom plate, for containing and supporting said substrate and filter circuit, a portion of said side walls supporting said connection means, wherein a first portion of said input signal is transferred through said filter circuit and a second portion of said input signal is transferred through a portion of said metal box in the wave-guided mode, said second portion providing a spurious characteristic of said filter, further comprising a dielectric plate on an inner surface of said metal box on the side of said top surface of said substrate, wherein said second portion of said input signal is transferred through said portion of said metal box and said dielectric plate in a guided mode, said dielectric plate shifting said spurious characteristic of said filter.

18. The filter as claimed in claim 17, wherein said side walls are combined with said bottom plate.

19. The filter as claimed in claim 17, wherein said side walls are combined with said top plate.

20. The filter as claimed in claim 17, wherein said resonator comprises a microstrip line.

21. The filter as claimed in claim 17, wherein said resonator comprises a dielectric resonator.

* * * * *